US006758338B2

(12) United States Patent
Lien

(10) Patent No.: US 6,758,338 B2
(45) Date of Patent: Jul. 6, 2004

(54) ACCESSABLE MEDICINAL DOSAGE CARRIER

(75) Inventor: Lynn Almyra Nelson Lien, Northfield, MN (US)

(73) Assignee: KJ Innovations, LLC., Minneapolis, MN (US)

( * ) Notice: Subject to any disclaimer, the term of this patent is extended or adjusted under 35 U.S.C. 154(b) by 168 days.

(21) Appl. No.: 09/821,663

(22) Filed: Mar. 29, 2001

(65) Prior Publication Data

US 2002/0139708 A1 Oct. 3, 2002

(51) Int. Cl.[7] ..... B65D 83/04
(52) U.S. Cl. ..... 206/534; 206/538
(58) Field of Search ..... 206/528, 538, 206/539, 105, 459.5, 232; 220/283, 506, 507, 8

(56) References Cited

U.S. PATENT DOCUMENTS

| | | | | | |
|---|---|---|---|---|---|
| 3,415,361 | A | * | 12/1968 | Adams, Jr. et al. | 206/221 |
| 3,618,751 | A | | 11/1971 | Rich | |
| 3,630,171 | A | * | 12/1971 | Huck | 116/308 |
| 3,743,084 | A | | 7/1973 | Douglas | |
| 3,899,080 | A | | 8/1975 | Brunda | |
| 3,921,804 | A | | 11/1975 | Tester | |
| 3,968,880 | A | * | 7/1976 | Ostrowsky | 206/540 |
| 4,093,103 | A | * | 6/1978 | Mumford | 206/1.5 |
| 4,384,649 | A | * | 5/1983 | Brodsky | 206/532 |
| 4,733,807 | A | * | 3/1988 | Porter et al. | 206/37 |
| 4,911,304 | A | | 3/1990 | Bunin | |
| 4,991,759 | A | * | 2/1991 | Scharf | 206/368 |
| 5,098,327 | A | * | 3/1992 | Ferrero | 446/487 |
| 5,242,005 | A | | 9/1993 | Borgardt | |
| D348,562 | S | * | 7/1994 | Smith | D3/203 |
| 5,520,307 | A | | 5/1996 | Miller et al. | |
| 5,549,204 | A | | 8/1996 | Toren | |
| 5,609,246 | A | | 3/1997 | Borghorst et al. | |
| D398,521 | S | * | 9/1998 | Coe | D9/339 |
| 5,836,661 | A | | 11/1998 | Oldorf | |
| 5,852,590 | A | | 12/1998 | de la Huerga | |
| 5,941,433 | A | | 8/1999 | Wilcher | |
| 5,988,429 | A | | 11/1999 | Coe | |
| 6,036,017 | A | * | 3/2000 | Bayliss, IV | 206/459.5 |
| 6,066,374 | A | | 5/2000 | Healy et al. | |
| 6,155,454 | A | | 12/2000 | George et al. | |
| 6,273,260 | B1 | * | 8/2001 | ColDepietro et al. | 206/459.5 |

* cited by examiner

*Primary Examiner*—Shian Luong
(74) *Attorney, Agent, or Firm*—Mark A. Litman & Associates, P.A.

(57) ABSTRACT

A pill dispenser comprises a lightweight container that carries a small number of doses (e.g., fewer than five and preferably one) of a medication to be taken during emergency or unexpected events. The device provides a symbolic indication of the nature of the event or condition for which the medication should be taken. The device may carry expiration date information for the medication. The device may also provide an environment proof closure to protect the medication, yet provide easy access to the medication when needed.

17 Claims, 3 Drawing Sheets

ACCESSABLE MEDICINAL DOSAGE CARRIER

BACKGROUND OF THE INVENTION

1. Field of the Invention

The present invention relates to a device for providing ready access to a dose of medication, the device being readily carried by the individual and identifying at least the nature of the medication.

2. Background of the Art

Medication in solid form such as tablets, pills, capsules or the like (hereinafter collectively referred to as pills) must sometimes be carried with a person at all times. For example, a person who has angina pectoris needs to carry nitroglycerin pills in the case of an angina attack. The angina sufferer must immediately take a nitroglycerin pill orally when an attack occurs, and may need to take additional pills if the first is not successful in quelling the attack. Further, although not related to a condition causing an incapacitating attack, many people carry medication with them that must be taken regularly for convenience sake. For example, a person who must take regular doses of an antibiotic medication (in pill form) throughout the day to combat an infection would find it convenient to carry the medication in the car, to work, and other places away from home. Recently, a pill form of insulin has been introduced allowing a diabetic person to take pills throughout the day to control the disease. Thus, it will be convenient, if not necessary, for such a person to carry these insulin pills with them at all times. Allergy sufferers also tend to carry antihistamine and decongestant medications with them where ever they go. In addition, efforts are under way to create a pill form of epinephrine that could be used by persons susceptible to incapacitating, or even life threatening allergic reactions. Clearly, if such pills become available, they will be carried with the user at a all times. These are just a few of many instances where persons who must take medication regularly during a day would find it advantageous to carry it with them.

Typically, those carrying medicine in the form of pills on their person simply keep these medications in their original containers. This practice, however, has drawbacks. The original containers, such as conventional plastic pill bottles, are bulky and are not easily carried in one's pockets. In addition, to gain access to the medicine, a person must first remove the cap of the container and then single out a pill for ingestion. This task can be very difficult if the person requiring the medicine has trembling or shaking hands, the person is undergoing an attack that necessitates taking the medication or the container has a child-proof cap. Additionally, the need for the medication may occur at night or while the victim is driving. Poor eyesight may make it particularly difficult for the patient to single out a pill for ingestion.

Sometimes, medication is transferred to small containers designed to allow a person to carry a few pills with them more conveniently than employing the original pill bottle. For example, nitroglycerin tablets are often carried in a small tube with an inside diameter just larger than the pills themselves. Usually five to seven pills are stacked one on top of another in this tube. Unfortunately, these containers are known to fail such as when the cap that seals the tube becomes cross-threaded and stuck thereby making it difficult to remove. The pills can also be crushed by the cap if too many are loaded within the dispenser. Additionally, if the pills become pulverized by movement within the container, the dosage is then uncertain and administration may become difficult.

Some of the same problems also manifest themselves in other commercially available pill containers. For example, so-called pill organizers are available. These organizers typically include multiple pill compartments each having a re-closeable hinged lid. One or more pills are placed into each compartment and the lid is closed. The lid is subsequently snapped open to gain access to the pill(s). Although such containers provide a convenient way to store and organize pills, they are not well suited for protecting the pills contained therein from the rigors of being carried around by the user. For instance, the person carrying the pills may be walking, running, or exercising, thereby subjecting the pills to shock and vibration as they bounce around inside the container. The resulting shock and vibration can cause the pills to break up or powderize. Nitroglycerin and aspirin are especially susceptible to degradation due to shock and vibration. These pills are very soft, having a consistency similar to compacted powdered sugar, and are easily pulverized if allowed to bounce around inside a container.

In addition to vibration and shock, the above-described pill containers also do not adequately protect the pills from other environmental factors that can degrade the medication. Moisture, high humidity, high temperatures, and even light can degrade some medications. The aforementioned pill bottles and organizers are not designed to seal or insulate the pills within, and so the pills can be affected by the aforementioned environmental factors. It is easy to imagine that such conditions could be encountered as the pills are carried outdoors or through high moisture environments by the user.

Pills are sometimes packaged in so-called soft or blister packs. These packs typically have multiple compartments, each of which contains a single dose of medication which is sealed within the compartment. Thus, the pills are protected against moisture and high humidity conditions. An individual compartment can be opened exclusive of the rest to obtained access to the pill held inside. Typically, this involves peeling back a covering forming a part of the pill compartment or pushing the pill through a frangible wall of the compartment. A blister pack permits the handling of a single dose of medication at a time, and minimizes the risk of contamination of the remaining pills. In addition, these blister packs are pre-packaged by the pill manufacturer and so there is no handling required by the user to load the pills as with the aforementioned pill containers.

It is well known to place blister packs into pill dispensers which house the pack and allow the pills to be extracted. These dispensers often have devices to assist in extracting the pill from a compartment of the pack. Typically, this involves some sort of plunger which pushes on the top of the compartment so as to push the pill through a frangible bottom covering. However, heretofore the intent behind such dispensers has been simply to facilitate extraction of the pill, rather than to protect the pills from the environmental hazard that are encountered when someone carries the medication with them. In fact, these dispensers are typically designed so that the blister pack compartments could be seen by the user. This allows the user to see where the remaining pills reside. For example, such a visual access is an important feature of dispensers for some types of birth control pills. Blister packs containing these birth control pills actually contain a series of different pills that must be taken in a specific sequence over the course of a month. Thus, the dispensers are designed so that the user can see the pills so that they can be taken in order on the intended days. These dispensers often include markings indicating the day and order in which the pills are to be taken.

As it is important to the current dispensers employing blister packs to allow visual access to the pills, they typically have openings through which at least the compartments containing the pills are exposed. In addition, these dispensers typically have openings adjacent the frangible bottom wall of the blister pack pill compartments through which the pill is extracted. Thus, even though the pills are sealed within the blister pack compartment, the compartments are susceptible to puncture or damage which would jeopardize the pill contained within. For example, if such a dispenser were to be carried with the user in a pocket or handbag, items such as pens, keys, and the like could puncture the blister pack compartments or push the pill hard enough to tear the frangible bottom covering. This would expose the pills to moisture and humidity. The open structure of these dispensers also provides no protection against the degrading effects of heat; and also light assuming the pill compartment has a transparent top covering which is typically the case. It is also noted that the blister packs are usually loosely supported within the dispensers and the pills themselves are often able to move within the blister pack compartment. Thus, potentially degrading levels of shock and vibration caused by the movements of the person carrying the dispenser could be transmitted to the pills.

Presently, the United States Pharmacopeia (USP) includes regulations regarding certain properties of containers for storage of medicinal agents formed into solid units, such as tablets, capsules, caplets, pills, and the like. In USP 23, Section 661, entitled "Light Transmission Standards for UV Transmission", incorporated by reference herein, the USP requires that medicinal agents which are intended for oral or topical administration must be stored in a container which permits transmission into the container of no more than 10% of ultraviolet and visible light having a wavelength of between 290 nm to 450 nm. Light in this range potentially can be harmful to such medicinal agents during extended storage. As a result, in the field of medicinal containers, most containers are generally formed from an opaque plastic in order to meet the USP requirements for light transmission. Such plastics inhibit the transmission through the container wall structure of light having a wavelength of between 290 nm and 450 nm. However, by virtue of the fact that these containers are opaque, transmission through the wall structure of visible light is also inhibited, preventing inspection of the medication in the container without opening the container. State laws generally require that a licensed pharmacist verify that the medication in each container correspond with the label designation on the container before a filled container can be released to a patient. Therefore, the pharmacist must open each filled container and inspect the contents of such containers to verify that the proper medication is enclosed. U.S. Pat. No. 6,066,374 describes a transparent, light resistant container is provided for storage of medicinal agents, such as tablets, capsules, and the like. In broad terms, the container includes a container body having self-sustaining wall structure of predetermined thickness formed from a synthetic resin composition. A quantity of a coloring agent dispersed in the resin composition. The quantity of the coloring agent is correlated with the thickness of the wall structure to permit transmission through the wall structure of no more than 10% of light having a wavelength of between about 400 nm to 450 nm while permitting transmission through the wall structure of adequate visible light to allow external visual inspection of printed characters on solid medicinal tablets and capsules stored in the container. In addition, an amount of a UV absorber is dispersed in the resin composition. The amount of UV absorber is also correlated with the thickness of the wall structure and sufficient to permit transmission through the wall structure of the predetermined thickness of no more than 10% of light having a wavelength between about 290 nm to 400 nm. Accordingly, U.S. Pat. No. 6,155,454 describes a pill dispenser that includes a pill carrier and dispenser housing. The pill carrier has a plurality of pill chambers, each of which initially holds a pill that is sealed from the outside environment by a pair of membranes. The dispenser housing has a pill carrier slot into which the pill carrier is disposed and an opening forming a pathway from the slot to the exterior of the housing. In addition, the dispenser housing has an integrated plunger disposed adjacent the slot and opposite the opening. This plunger has a projecting punch head capable of extending into a pill chamber to push a pill out of dispenser housing opening whenever the plunger is depressed by a user. The pill chamber is first placed in alignment with the punch head and housing opening by displacing the pill carrier within the pill carrier slot. An indexing mechanism is preferably used to ensure the necessary alignment. In a second embodiment of the pill dispenser, there are a plurality of integrated plungers, each of which forms a top covering of a respective one of the pill chambers. These plungers are capable of dispensing a pill contained within its associated pill chamber. In operation, the pill carrier is drawn out of the pill carrier slot to sequentially expose each of the pill chambers and to allow the user to dispense a pill by actuating its associated plunger.

U.S. Pat. No. 5,988,429 describes a dispenser for a blister pack that contains pills in a matrix of blisters has a support member for receiving the pack with a rupture side of the pack facing the support member. The support member has at least one opening for passage of pills pushed through the rupture side from the blister pack. A tab lid is hinged to the support member in a position covering the blister pack, the tab member having a matrix of tabs, each movably mounted to the tab lid and each positioned to be over a blister of the blister pack. Movement of a tab of the tab lid toward the support member effects compression of a blister to rupture the rupture side and push a pill out of the blister and through the opening of the support member. A cover lid can also be hinged to an opposite edge of the support member to cover the tab lid.

Recent studies have shown that some medications taken quickly after the onset of certain medical conditions can greatly enhance survival and recovery. For example, it has been shown that heart attack victims can greatly increase their chance of survival if they quickly take an aspirin after onset of the attack. It can also be important for heart attack victims to have quick access to nitroglycerin. Unfortunately, few people carry aspirin, or other helpful emergency medications, with them wherever they go. This is particularly true with respect to men because of the lack of a purse or other convenient compartment for carrying medication. Also, with increasing numbers of people exercising (e.g., walking, hiking, biking, etc.), people are away from emergency medication while engaging in activities that may aggravate medical conditions such as heart and lung problems. Even people who do carry aspirin, or other medications, are likely carry them somewhere where the medication is not readily accessible in a medical emergency (e.g. a purse or briefcase). There presently exist a number of different ways of packaging medication (e.g., pills, capsules, tablets, vials, etc.) for consumer use. For example, various medication packaging systems are disclosed in U.S. Pat. Nos. 5,242,005; 3,899,080; 3,921,804; 5,609,246; 3,618,751; 5,549,204; 3,743,084; and 4,911,304. One focus of innovation in medication packaging, in addition to maintaining the integrity of the medication, has been to prevent unsupervised access, for example, by children. However, conventional medication packaging solutions do not address the problem of allowing quick access to the medication during an emergency. Therefore, U.S. Pat. No. 5,941,433 describes a medication attachment device and method for attaching medication in close proximity to a body. The device includes a container for holding medication and an attachment mechanism coupled to the container. The attachment mechanism is operable to attach the container to personal apparel, such as clothing, accessories or jewelry. In one embodiment, the attachment mechanism is a flexible body that can be wrapped around the personal apparel. In another embodiment, the attachment mechanism is a clamp formed by a hinge portion that can be clamped to the personal apparel. The device shows one or two bubble-pack single dose medcine holders connected to a bendable wire. The wire is secured to apparel to allow the user to carry the medicine. The medication, however, is still carried in a conventional dispenser, many of which are difficult to open (e.g., bubble pack, metal foil sealed pack, etc.).

U.S. Pat. No. 5,520,307 describes a medication dispenser cap and container comprises a base connected to the container and including a non-circular, for example polygonal, indication portion with multiple points or nodes. A cover which also has a non-circular shape is rotatably mounted to the base and moveable into aligned closed position with the base. The base includes multiple openings around its periphery and the cover includes one opening which can be aligned with one of the base openings to dispense medication, for example pills, from the container. The openings are aligned only when the cover is offset with respect to the base. This exposes parts of the base which may carry indicia that indicate when the dosage should be taken.

U.S. Pat. No. 5,836,661 describes a dispenser for storing, displaying and manually dispensing individual box-shaped packages, said dispenser comprising: a housing having a generally vertically extending rear wall and a generally vertically extending front wall spaced from the rear wall to form an open space between the walls, dividers spaced apart between the front and rear walls to form within the open space of the dispenser one or more vertically-extending magazines each throughout its length being substantially uniform in width and uniform in depth and adapted to receive one or more box-shaped packages to be stored and dispensed, each magazine having an opening in the front wall that defines a dispensing opening at the lower end of the magazine, a support at the lower end of each magazine near the dispensing opening adapted to support a plurality of packages in a stacked relationship in a magazine, a lip extending across the lowest portion of the dispensing opening and having a top edge extending above the support, the width of the dispensing opening being greater than the width of a package to be contained in the magazine and the height of the dispensing opening above the top edge of the lip being greater than the height of a single package, a recess in the support and extending toward but not into the back wall to provide for manual lifting of a lowermost package resting on the support over the lip and through the dispensing opening, the front wall having an upper part above the dispensing opening and a lower part below the dispensing opening, and the lower part of the front wall having a recess beneath the recess in the support at the lower end of each magazine.

U.S. Pat. No. 5,852,590 describes a multi-piece, automated medication container having a first piece with an interactive label and a machine readable and writable electronic memory strip. The memory strip contains prescription information, medication information and program codes that are downloaded to a second piece having a computer processor. In one embodiment of the invention, the interactive label is affixed to a vial of a standard childproof container. The vial is sealed by an automated cap. The automated cap includes sensors for reading the information and codes on the memory strip and a memory for storing the information and codes. The automated cap also includes a display for visually or audibly indicating desired information to the patient, such as when to take the next dose of medication. A computer controlled locking assembly in the cap presents its removal before the prescribed time for taking the next dose of medication. The sensors also obtain actual medication consumption information based on when the container is opened. This actual consumption information is used to keep inventory information regarding the number of doses remaining in the container. The actual consumption information and inventory information is stored in the memory of the cap or sent to the interactive label to update the memory strip. The memory strip can also contain contraindication information for downloading to a personal home computer or a hospital or nursing home computer. In another embodiment, the interactive label is affixed to a blister pack containing individual doses of medication. The blister pack is then placed in an automated dispenser.

SUMMARY OF THE INVENTION

A pill dispenser comprises a lightweight container that carries a small number of doses (e.g., fewer than five, four or three pills, and preferably one) of a medication to be taken during emergency or unexpected events. The device may provide a symbolic indication of the nature of the event or condition for which the medication should be taken. The device may carry expiration date information for the medication that is readily viewable to the user or a samaritan.

The device may also provide environment proof closure to protect the medication, yet provide easy access to the medication when needed. By environment-proof, different levels of safety may be provided. The cases may need to be moisture proof, water proof, stress or impact proof, air proof, light proof, insulative (to reduce thermal effects) and the like. The details on providing these capabilities are well within the skill of the ordinary artisan, but will also be described in greater detail later.

DETAILED DESCRIPTION OF THE INVENTION

A dispenser for solid form medications, such as pills, capsules, caplets, gel-tabs, tablets or the like (generically referred to as pills) is provided as a readily openable container that supports a small number of doses. The dispenser comprises an openable housing, an interior support for the pill(s), and a capability of being securable to other articles (facilitating carriage of the dispenser). The following descriptions are therefore exemplary of the device and are not intended to be limiting. Where a specific system (such as a hinging system of locking system) is described with a particular example, that exemplification is not intended to limit the exercise of routine ability by the skilled artisan to the exclusion of known equivalents.

Figure 1:
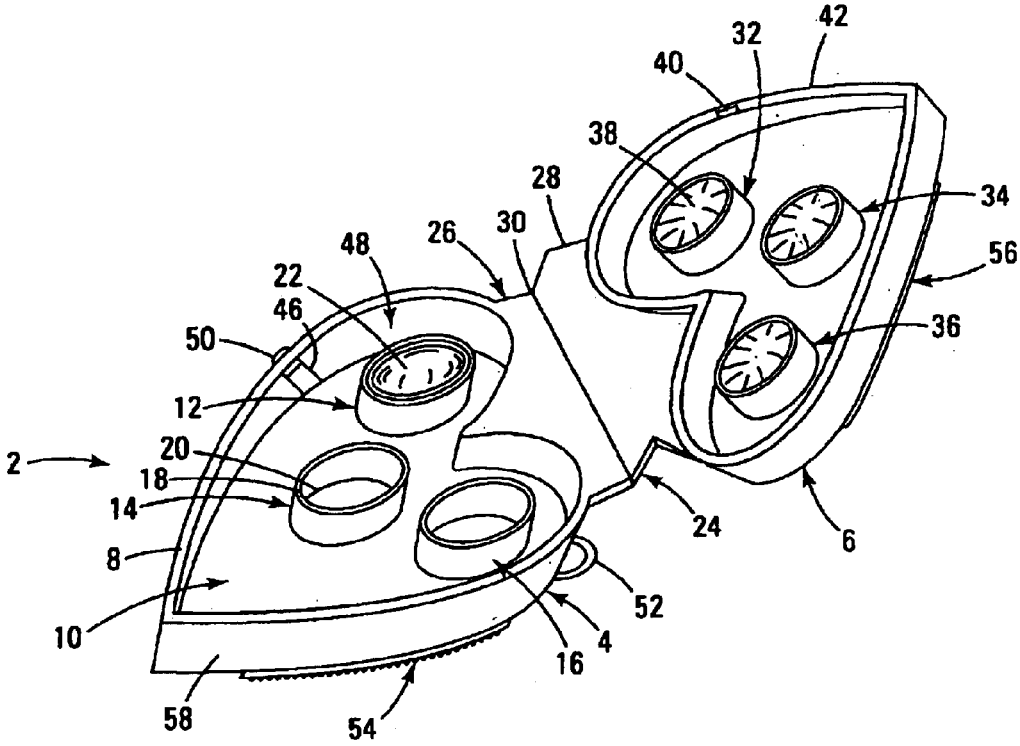
FIG. 1 shows a perspective cut-away view of a dispensing article with two pills therein.
Figure 2:
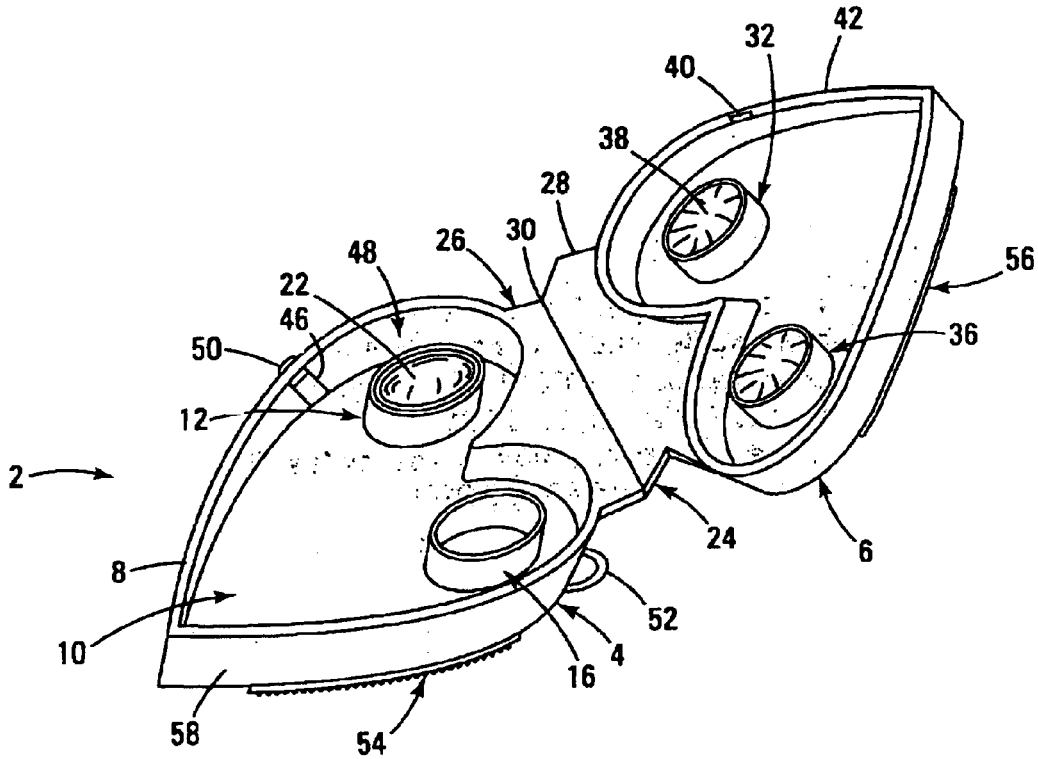
FIG. 2 shoes a perspective drawing of a dispenser of the invention.
Figure 3:
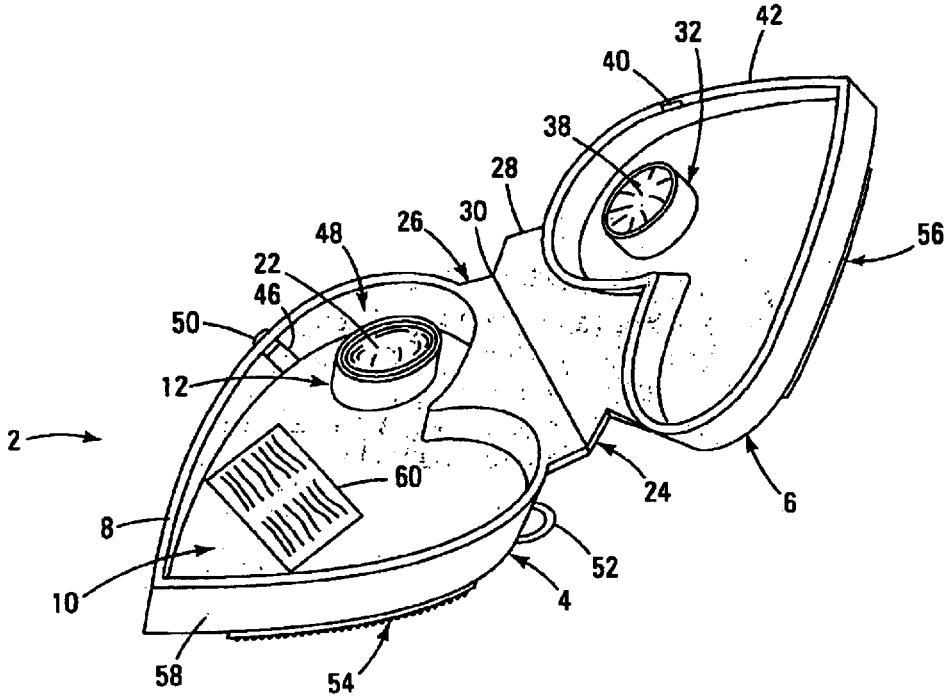
FIG. 3 shows a perspective drawing of a dispenser of the invention.

FIG. 1 shows a dispenser 2 comprising a bottom section 4 and a top section 6. The bottom section 4 is in the form of a heart shape to facilitate identification of the purpose of the dispenser 2 for heart related health events. A wall 8 on the bottom section 4 forms a storage area 10 within the bottom section 4. Within the storage area 10 are shown three pill storage retainers 12, 14 and 16. The typical pill storage retainer (e.g., 14) has a wall 18 and a central open area 20 that is large enough to support or completely contain a pill (e.g., 22 shown in pill storage retainer 12). The central open area 20 should have a sufficient diameter or open area to be able to allow a pill to comfortably and loosely fit within the open area 20. Here, the shape of the pill 22 is shown to be circular, but the pill may be square, ellipsoid, tubular, octagonal, cubic, or other geometric shape, and the open area 20 to receive such a shaped pill should correspond or provide a supportive shape for that particular pill. By having the shape of the open area 20 correspond to the shape of the pill, the sides of the open area 20 will support the pill, capsule, caplet or the like, reduce the amount of shifting that will occur within the container, and reduce damage, breakage, or powdering of the product. The relative fit between the medicine and the support should be tight enough to restrict movement, without providing such a gripping contact that the pill would be physically degraded or removal would be made difficult. To avoid this, the medicine should be able to fall from the open area 20 by the action of tipping or inverting the open container, and/or the sides of the open area 20 should be lower than the top of the medicine (e.g., less than 80% of the medicine height, less than 50% of the medicine height, and the like). A square open area 20 with each interior side being greater than the diameter of a circular cross-sectioned pill will satisfy the support requirement, without having to have the shape of the pill and the open area 20 be geometrically comparable.

The ease of opening of the container has already been addressed. There are other considerations in this regard that can be made to improve the performance of the device of the present invention. For example, arthritic patients may have difficulty in opening any container. There are many common opening mechanisms that can used that are easily accessible to the user. For example, the joint may be spring loaded or closed against an elastic force (e.g., the elastic resistance of a polymeric living hinge). This force may be used to assist in the opening of the closure. There may be a simple locking mechanism that, when released, will allow these forces to open the container. For example, a toothed tab, where the tab snaps into a hole in the container, can be opened by pressing the tooth that extends through the tab, and the elastic forces will then spring open the dispenser. The containers may be used more than once, but it is preferred that the dispenser be used only once, with the expiration information being specific to the original packaging or first stocking of the dispenser.

The dispensers can be provided commercially in many different formats that will accomplish the beneficial objectives of the present invention. For example, the dispensers may be separately provided, usually with a wrapping for protection against tampering. The wrapping may have the use information printed on the wrapping, on a support for the wrapping, or on an insert inside of (but preferably visible through) the wrapping. A preferred method of product distribution would be to have a bubble wrap package, with the complete dispenser (and possibly the medicine already within the dispenser) enclosed in the bubble wrap. The bubble wrap may have printed on it or printed on another component information of value to a patient. For example, warning signs for heart attacks or strokes may be provided on the packages. The packages may be provided in distinct colors for male and female patients/users, with distinct information provided for the symptoms that are more closely aligned with that particular sex. It is well known in the medical community that some symptoms of heart attacks and strokes are different between the sexes. By providing the sexually unique information on sexually distinct packages, the information can be more appropriately provided to the user. If information for both sexes were provided on a single dispenser system, the increased amount of information would be less likely to be read, and therefore the information would diminish in value.

The bottom section 4 of the dispenser 2 is shown with a hinge connection 24 to the top section 6 of the dispenser 2. The hinge connection 24 is shown as a 'living hinge' system in which the two solid flange elements 26 and 28 are connected by a seam 30 between the two solid flange elements 26 and 28. The seam 30 allows the hinge connection 24 to flex and open the top section 6 and the bottom section 4 of the dispenser 2. Alternative hinge systems are well known to the ordinary skilled artisan, but the living hinge is shown for its simplicity and low cost. A toothed hinge, door-type pin hinge, spring hinge, ring hinge, or any other hinge or swiveling system. Where specific environment resistive features are desired on necessary in the dispenser, the closure mechanism and the locking mechanism are integral parts of these effects. For example, where the tightest seal is desired in the closure, yet ease of opening must be retained, a light wax seal may be applied over the edges of the opening lines on the dispenser. For example, a 0.1 mm microcrystalline wax or edible wax may be coated over the connecting line of the top and bottom half of the dispenser, a light tacky material that does not dry out and form an adhesive seal (e.g., pressure-sensitive adhesive), or other readily breakable or separable bonding agent may be used to close out environmental features without making the dispenser too difficult to be easily opened by a user in distress. The material used for the sealing of the container may be used as a one-time only (single use) opening option, with no possibility of being re-sealed. Thos would provide complete security and peace of mind to he consumer that the container is stocked with the necessary medication and that it cannot be contaminated. The container may also be made of a completely edible material (e.g., amylose, amylopectin, starch-based polymers, etc.) again assuring a single use of the dispenser and there is no issue of complexity in opening the container during patient distress. The container or the seal or the sealing material may also be phosphorescent or luminescent to assist the user or a Samaritan in finding the dispenser rapidly when necessary, or alerting a Samaritan of the presence of the medical device. The fluorescence may even be in the shape of a caduceus or other medical symbol. A light emitting attachments, such as a flashing light emitting diode driven by a battery, may also be attached to the dispenser. The flashing light would also provide two distinct and unique functions. The LED signal would be highly apparent to a casual passerby in the case of an emergency. The battery/frequency system could be coordinated with the expiration date of the medicine, so that termination of the light function would correspond to the expiration date of the medicine. The dispenser/container of the present invention could also be provided as added value on a bottle or package of medicine as a bonus feature. There might also be an optional feature provided to provide the container or a label on the container with a pigment or dye that would change color and/or fade over time. This would alert the consumer of an expiration date for the medication by the change in color. It is also possible or desirable to include other active ingredients to enhance the color change function. Upon a specific color change or degree of color change, the consumer could discard the container or refill the container as needed.

The case or dispenser material may be transparent or translucent to show the presence of the medicine, and/or may be colored to provide UV or infrared protection. The container may be made of polymeric materials (e.g., vinyl resins, polyolefin resins, acrylic resins, polyamide resins, polyurethane resins), composite materials, metals, wood or the like. The maintenance of an air tight or water tight closure, along with a proper selection of materials based on their specific gravity, will enable the dispenser to be floatable, so that it cannot be as easily lost in a water environment.

The top section 6 of the dispenser is shown with pill top support elements 32, 34 and 36 that are positioned to overlay or contact the three pill storage retainers 12, 14, and 16 and restrain the movement of pill(s) (e.g., 22) within any of the three pill storage retainers 12, 14, and 16. The three pill storage retainers 12, 14, and 16 are drawn with their walls (e.g., 18) being relatively vertical. This is more desirable than other shapes such as a shallow trough, hemisphere, hemispheroid, sloped walls or the like. Although these alternative shapes are functional and useful within the scope of practice of the present invention, the more upright wall structure 8 better restricts the movement of the pill, particularly when the dispenser 2 is opened. On the other hand, the top support elements 32, 34 and 36 may be preferably sloped on the interior 38 to provide constraint for a pill 22 as the straight wall sides 18 are not needed to support the pill 22 when the dispenser 2 is opened. Straight sidewalls are therefore optional on the top support elements 32, 34 and 36.

In addition to these features, an engaging structure may be formed between the bottom section 4 and the top section 6. The engaging or snapping section may include the interior wall 48 of the side 8 and a fitted and raised top wall section 42 that snuggly fits into the interior wall 48 when the top section 6 is moved across the hinge connection 24 to close the dispenser 2. An additional or alternative locking feature may be provided as a dog-ear or clip arrangement such as a fixed attachment clip 40 on the top section 6 and the movable engaging clip 46 on the bottom section 4. The locking feature is shown with a release button 50 on the side 8 of the bottom section 4 that when pressed disengages the engaging clip 46 from the attachment clip 40, allowing more ready release of the top section 6 from the bottom section 4.

Additional features may also be provided on the dispenser 2 as optional features. For example, a chain or strap engaging clip 52 is shown for use with a chain or strap (not shown) to attach the dispenser to another article or to a person. Another alternative attachment feature is shown as layer 54 on the bottom section 4. This optional attachment system 54 may comprise a pressure sensitive or more aggressive adhesive layer (usually provided in the original sale with a strippable cover sheet) of half of a hook and loop fabric attachment system (e.g., Velcro®). A safety pin attachment (as with a brooch) may also be used on the back of the dispenser. A magnet or other adherent system may be attached to the back of the dispenser so that ir could adhere to a variety of locations.

An additional and highly advantageous feature in the practice of the present invention is the information content that may be provided as layer 56 here shown on the top section 6. The information content of layer 56 may also be provided on a sidewall 58 of the dispenser 2 or on any other convenient face. The layer 56 may contain various types of information, in whatever form is convenient. The information, as in this example with the heart-shaped dispenser 2 with the pill 22 comprising aspirin for use with a heart attack or stroke or nitroglycerin for angina, could include any or all of the following in brief but precise language: the anticipated condition (e.g., "Heart Attack Alert"), dosage to be administered (e.g., "Chew One Aspirin" or "Place Capsule Below Tongue"), expiration date (e.g., "Replace Aspirin on Feb. 14, 2010"), person (including Doctor) to call in emergencies, and the like. A solid state countdown clock that identifies the approaching date on which the pill should be replaced may also or alternatively be provided.

The dispenser is preferably carried in a visible position on the wearer, such as attached as a brooch, as a necklace, as a bracelet, as a lapel pin, as a hatpin, as a band on a golf hat or other sports hat, and the like. The dispenser may be attached to a key chain, hooked over a button on a jacket, on the dashboard of a car, boat, motorcycle, snowmobile or other vehicle.

The raised top wall section 42 may be provided with flexible or conformable material to assist in providing a water-tight/moisture-tight seal around the pill 22. A weak adhesive may be used on the top wall section 42, but this would likely necessitate discarding the entire dispenser when the expiration date of the medication has been reached, rather than merely replacing the pill. One particularly desirable way of providing the dispenser, with an additional reminder of the replacement date for the medication is providing the dispenser concurrent with a special occasion (such as Valentine's Day) and with a special message on the dispenser. For example, dispensers may be provided with a slogan such as "With All My Heart" and a date (e.g., Valentine's Day 2009) so that the dispenser could be replaced, with a new aspirin or a refill/replacement added every Valentine's Day, with the date acting as an automatic reminder. Similarly, the dispenser could be provided on anniversary dates (birthdays, weddings, or anniversary of a heart attack) for an additional impact and reminder to replace the pill.

What is claimed:

1. A dispenser of medication in the form of a solid pill for a specific anticipated medical condition comprising:

a housing;

the housing comprising a top section and a bottom section;

the top section and bottom section forming an enclosure with an interior surface;

the top section and the bottom section are attached so that the top section may be removed from engagement with the bottom section without being separated from the bottom section;

the bottom section having a restraining holder for the pill;

the top section having a closing element that engages with the restraining holder within the bottom section to prevent the pill from moving without restraint within the enclosure;

a pill within the restraining holder;

the enclosure having no more than four separate restraining holders within the enclosure; and the exterior of the dispenser having an indicator for the expiration date or anniversary date of pill placement within the dispenser.

2. The dispenser of claim 1 wherein the shape of the dispenser is identifiable with the anticipated medical condition or the treatment for the medical condition.

3. The dispenser of claim 2 wherein the shape of the dispenser is in the shape of a heart.

4. The dispenser of claim 3 wherein the enclosure has no more than two separate restraining holders within the enclosure.

5. The dispenser of claim 3 wherein the enclosure has no more than one separate restraining holder within the enclosure.

6. The dispenser of claim 2 wherein the top and bottom section engage in a water-tight seal.

7. The dispenser of claim 6 wherein the enclosure has no more than two separate restraining holders within the enclosure.

8. The dispenser of claim 6 wherein the enclosure has no more than one separate restraining holder within the enclosure.

9. The dispenser of claim 2 wherein the enclosure has no more than two separate restraining holders within the enclosure.

10. The dispenser of claim 2 wherein the enclosure has no more than one separate restraining holder within the enclosure.

11. The dispenser of claim 10 wherein the dispenser has attached to itself a system for attaching the dispenser to another article.

12. The dispenser of claim 2 wherein the dispenser has attached to itself a system for attaching the dispenser to another article.

13. The dispenser of claim 1 provided in a package for sale, the package for sale containing written information about warning signs for a medical condition that would be treated by administration of medicine within the dispenser.

14. The dispenser of claim 13 wherein the information comprises information focused upon information specific to the sex of a potential patient, and the package identifies the dispenser or information as being specific to the sex of the potential patient.

15. The dispenser of claim 13 wherein the dispenser is water-tight.

16. A kit containing within a single container the dispenser of claim 1 and written information concerning a medical condition for which the solid pill comprises a treatment.

17. The kit of claim 16 wherein the written information contains information concerning both warning signs for the medical treatment and usage information for the solid pill.

* * * * *